US005290177A

United States Patent [19]

Chal

[11] Patent Number: 5,290,177

[45] Date of Patent: Mar. 1, 1994

[54] SHIELDING UNIT OF A NETWORK CONNECTOR

[76] Inventor: Ming-Kuang Chal, 3F-8, No.255, Sec.2, Chung-Shan Rd., Chung-Ho City, Taiwan

[21] Appl. No.: 67,775

[22] Filed: May 26, 1993

[51] Int. Cl.[5] ..... H01R 13/648

[52] U.S. Cl. ..... 439/610; 439/607

[58] Field of Search ..... 439/607-610

[56] References Cited

U.S. PATENT DOCUMENTS 2,902,533 9/1959 Murphy ..... 439/607
2,908,742 10/1959 Murphy ..... 439/607
5,169,346 12/1992 Johnston ..... 439/607
5,190,464 3/1993 Chou et al. ..... 439/607

*Primary Examiner*—Gary F. Paumen

*Assistant Examiner*—Hien D. Vu

*Attorney, Agent, or Firm*—Townsend and Townsend Khourie and Crew

[57] ABSTRACT

A shielding unit of a network connector is disposed in an elongated casing of the connector adjacent to one connecting end thereof. The shielding unit includes a main shielding member that has a plate member fixed to on a bottom of the elongated casing with three upright posts that extend vertically from the plate member so as to form two gaps, and two auxiliary shielding plates connected detachably to the main shielding member. The two shielding plates cooperate with one another to form a wall body to close the two gaps. One of the auxiliary shielding plates has an inlet hole which serves as the sole access that leads to an interior of the elongated casing.

2 Claims, 3 Drawing Sheets

SHIELDING UNIT OF A NETWORK CONNECTOR

BACKGROUND OF THE INVENTION

1. Field of the Invention

The invention relates to a shielding unit, more particularly to a modified shielding unit of a network connector which is used to connect a computer and a computer network, which modified shielding unit provides a better shielding effect than the prior art.

2. Description of the Related Art

FIG. 1 is an illustration of a conventional network connector which is used to connect a computer and a computer network so as to effect signal transmission therebetween. The conventional network connector has one end attached to a cable of the computer while two pairs of conducting pins are provided at the other end. When an end of the conventional network connector of the computer is attached to another network connector of the computer network, the conducting pins of the two network connectors are interconnected so that communication can be established between the computer and the computer network. The conventional network connector includes an elongated insulated casing (A) that has a front end (A1) which is provided with an insert head (B), a rear end (A2) which is provided with a connecting head (C), a bottom (A3), a top cover (E) opposite to the bottom (A3) and a surrounding wall (A4) which interconnects the bottom (A3) and the top cover (E) so as to define the elongated casing (A). The front end (A1) of the elongated casing (A) has two pairs of first and second conducting pins (A11) which are disposed lengthwise and which extend rearwardly therefrom. The surrounding wall (A4) of the elongated casing (A) is provided with three inlet holes (A21), one of which is formed through the rear end (A2) so that connecting wires of the connecting head (C) can enter into the elongated casing (A) via the inlet hole (A21) of the rear contact end (A21) while an adjacent inlet hole (21) permit entry of a first end of a computer cable therethrough so as to connect with other conducting elements in the elongated casing (A). The elongated casing (A) further includes a shielding unit disposed therein adjacent to the rear end (A2) for minimizing electromagnetic interference.

The shielding unit includes a main shielding member (D) having a plate member (D3) fixed to the bottom (A3) of the elongated casing (A) and four upright posts (D1) that extend upwardly from the plate member (D3) and that cooperatively form a fence to prevent electromagnetic interference signal from entering into the elongated casing (A) via one of the inlet holes (A21) of the surrounding wall (13).

A main drawback of the above-mentioned shielding unit is that the four upright posts (D1) in the main shielding member (D) cooperatively define four gaps (D2) which are in communication with the three inlet holes (A21) so as to achieve wire connection, these gaps consequently decrease the shielding efficiency of the network connector.

SUMMARY OF THE INVENTION

A main objective of the present invention is to provide a shielding unit that is to be employed in a network connector, which shielding unit can provide a better shielding effect than the prior art.

According to the present invention, a shielding unit of an elongated casing of a conventional network connector is provided with at least two auxiliary shielding plates so that the modified shielding unit can effectively shield an external interference signal from entering into the connector. One of the auxiliary plates has an inlet hole.

The shielding unit of the conventional network connector includes a plate member disposed in the elongated casing adjacent to one end thereof and at least three spaced upright posts that extend from the plate member and which cooperatively define two gaps. The auxiliary shielding plates are to be connected detachably to the upright posts in order to close the two gaps. The inlet hole in one of the auxiliary shielding plates permits entry of one end of a computer cable into the elongated casing when a sealing lid that covers an inlet hole of the elongated casing is removed. Since the gap adjacent to the inserted cable is closed by the remaining one of the auxiliary shielding plate, the conventional network connector which is installed with the modified shielding unit of the present invention has a better shielding effect than the prior art.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
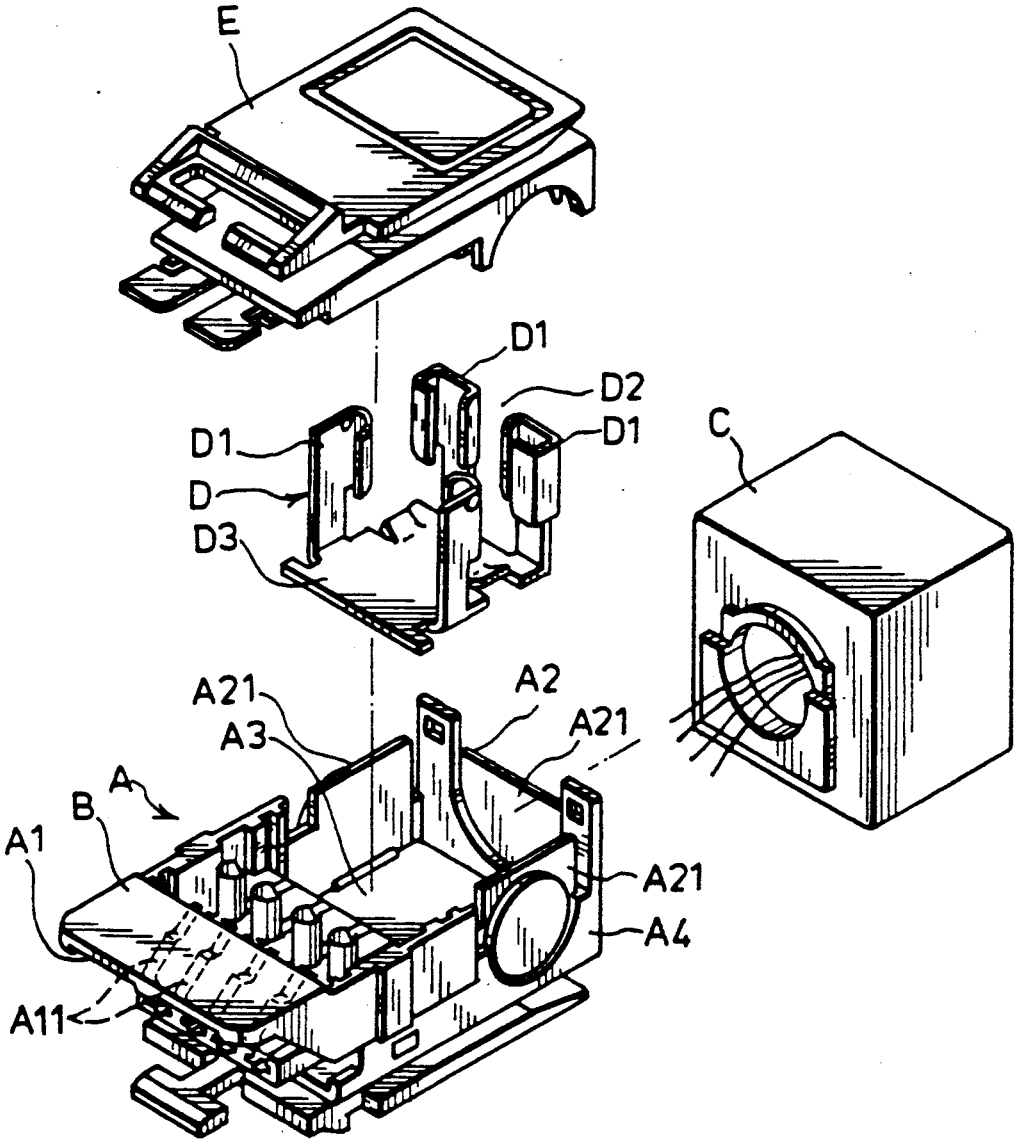
FIG.1 (PRIOR ART)
FIG. 1 is an exploded view of a network connector that is provided with a conventional shielding unit.
Figure 2:
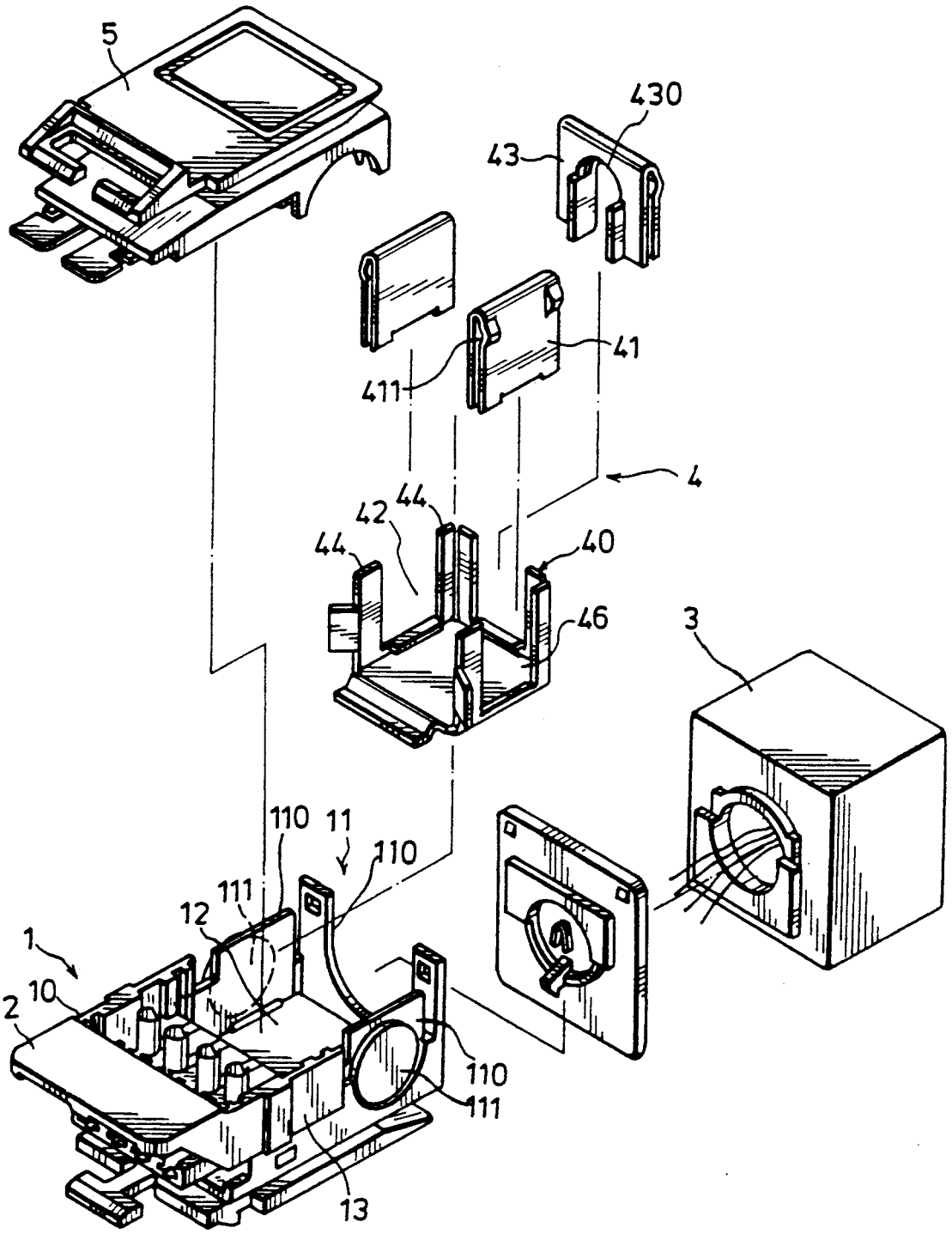
FIG. 2 shows an exploded view of the network connector of FIG. 1 when provided with a modified shielding unit according to the present invention.

Referring to FIG. 2, a network connector includes an elongated casing (1) having a top cover (5) , a bottom (12) , a front connecting end (10) which is provided with ian insert head (2), a rear connecting end (11) which is provided with a connecting head (3), and a surrounding wall (13) which interconnects the top cover (5) and the bottom (13) to define the elongated casing (1). The surrounding wall (13) has three first inlet holes (110), one of which is formed through the rear connecting end (11). Three sealing lids (111) are provided on the surrounding wall (13) so as to close the first inlet holes (110). Since the present invention is related only to a shielding unit that is employed in the elongated casing (1), the remaining components within the elongated casing (1) have structures similar to those of the conventional network connector and will not be detailed herein.

The shielding unit (4) includes a main shielding member (40) which is disposed in the elongated casing (1) adjacent to the rear connecting end (11) and which has a plate member (46) fixed to the bottom (12) of the casing (1) and a plurality of upright posts (44) that extend vertically from the plate member (46). The upright posts (44) of the main shielding member (40) cooperatively define four gaps (42), three of which are respectively aligned with the first inlet holes (110) of the surrounding wall (13). The shielding unit (4) further includes three auxiliary shielding plates (41, 43), each of which has two layers that are connected to each other at side ends so as to form a clearance (411) therebetween. The auxiliary shielding plates (41, 43) are detachably connected to the main shielding member (40) so as to close the three gaps (42) which are in respective alignment with the first inlet holes (110) of the surrounding wall (13). One of the auxiliary shielding plates (43) has a second inlet hole (430) formed therethrough.

Figure 3:
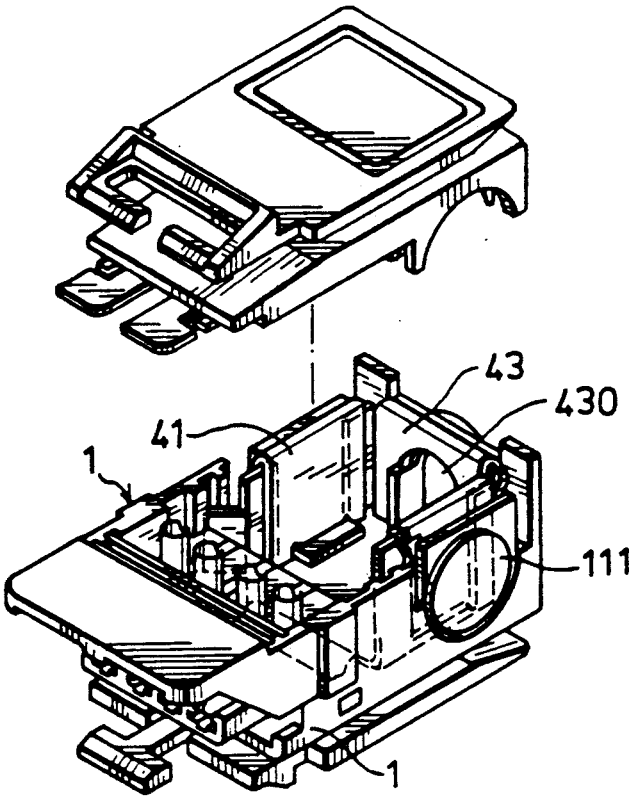
FIG. 3 is a partially assembled view of the network connector of FIG. 2.
Figure 4:
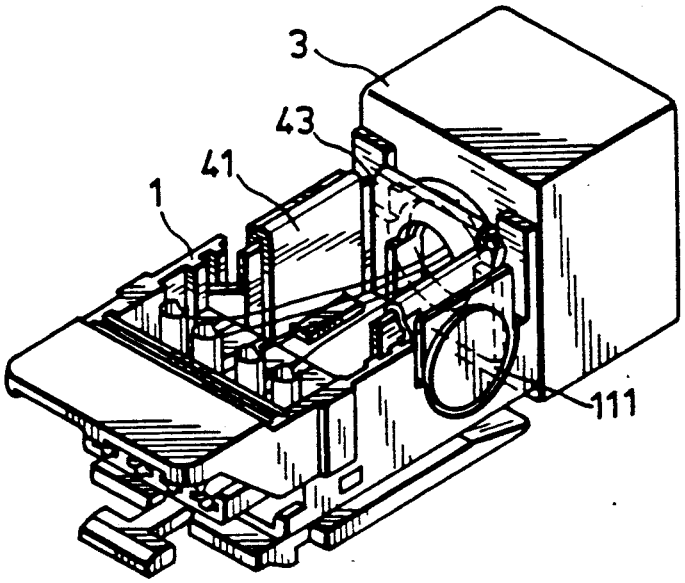
FIG. 4 is an assembled view of the network connector with the top cover removed.

Referring to FIGS. 2, 3 and 4, the sealing lid (111) that closes the first inlet hole (110) of the rear end (11) is removed so as to expose the first inlet hole (110) of the rear end (11). The auxiliary shielding plate (43) is attached detachably to the main shielding member (40) such that the second inlet hole (430) is communicated with the first inlet hole (110) of the rear connecting end (11) of the elongated casing (1) while the remaining two auxiliary plates (41) are connected detachably to the main shielding member (40) adjacent to the shielding plate (43). Under this condition, the three auxiliary plates (41, 43) cooperatively form a U-shaped wall body. Since the second inlet hole (430) of the shielding plate (43) is smaller than the first inlet hole (110) of the rear end (11), the second inlet hole (430) forms a sole access leading to an interior of the elongated casing (1). Since the U-shaped wall body is located adjacent to the rear connecting end (11) of the elongated casing (1), it can effectively shield the interior of the elongated casing (1) from an electromagnetic interference signal which enters into the latter via the second inlet hole (430) thereof.

In the event that, the connecting head (3) is to be attached sideways of the elongated casing (1), one of the sealing lids (111) which covers the first inlet hole (110) adjacent to the rear connecting end (11) should be removed in a similar manner, thereby exposing the first inlet hole (110) which would lead to the interior of the elongated casing (1). The shielding plate (43) is provided adjacent to the above-mentioned first inlet hole (110) of the elongated casing (1) such that the second inlet hole (430) of the shielding plate (43) serves as a sole access that leads to the interior of the elongated casing (1). The feature and function of the three auxiliary shielding plates (41, 43) are the same.

Since the auxiliary shielding plates (41, 43) provide an additional shielding effect to the main shielding member (40), the network connector that is equipped with the present shielding unit possesses a stable connection when it is used to connect a computer and a computer network. Thus, the feature and object of the present invention are achieved.

While a preferred embodiment has been described and illustrated, it will be apparent that many changes and modifications can be made in the general construction and arrangement of the present invention without departing from the scope and spirit thereof. Therefore, it is desired that the present invention be limited not to the exact disclosure but only to the extent of the appended claims.

I claim:

1. A shielding unit of a network connector, said connector including an elongated hollow casing having a top cover, a bottom, a side wall connected between said top cover and said bottom so as to define said elongated casing, and a connecting end, said hollow casing further having at least two first inlet holes formed through said side wall adjacent to said connecting end, said shielding unit including a main shielding member mounted in said hollow casing adjacent to said connecting end, said main shielding member having a plate member fixed to said bottom of said hollow casing and at least three spaced upright posts which extend from said plate member toward said top cover of said hollow casing so as to define at least two gaps, said gaps being respectively communicated with said first inlet holes;

the improvement comprising: said shielding unit further including at least two auxiliary shielding plates connected detachably to said upright posts of said main shielding member, said auxiliary shielding plates cooperatively forming a wall body so as to close said gaps, one of said auxiliary shielding plates having a second inlet hole.

2. The shielding unit as defined in claim 1, wherein each said shield plate includes two layers which are connected integrally at side ends thereof so as to form clearance therebetween.

* * * * *